US006204597B1

(12) United States Patent
Xie et al.

(10) Patent No.: US 6,204,597 B1
(45) Date of Patent: Mar. 20, 2001

(54) FIELD EMISSION DEVICE HAVING DIELECTRIC FOCUSING LAYERS

(75) Inventors: Chenggang Xie, Phoenix; John Song; Sung P. Pack, both of Tempe, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/246,857

(22) Filed: Feb. 5, 1999

(51) Int. Cl.[7] ..... H01J 1/02
(52) U.S. Cl. ..... 313/310; 313/309
(58) Field of Search ..... 313/310, 309, 313/336, 351, 495, 422

(56) References Cited

U.S. PATENT DOCUMENTS 5,430,347 7/1995 Kane et al. .
5,473,218 12/1995 Moyer .
5,552,659 9/1996 Macaulay et al. .
5,647,785 * 7/1997 Jones et al. ..... 445/24
5,804,909 * 9/1998 Nilsson et al. ..... 313/309
5,837,331 * 11/1998 Menu et al. ..... 427/569

FOREIGN PATENT DOCUMENTS 0848406 6/1998 (EP) ..... H01J/9/02
0 795 622 * 9/1997 (GB) ..... 313/310

* cited by examiner

*Primary Examiner*—Nimeshkumar D. Patel
*Assistant Examiner*—Todd Reed Hopper
(74) *Attorney, Agent, or Firm*—S. Kevin Pickens; William E. Koch

(57) ABSTRACT

A field emission device (110, 210, 310, 410) includes an electron emitter (124), a first dielectric focusing layer (122) defining a first aperture (127), and a second dielectric focusing layer (123) defining a second aperture (133). Second dielectric focusing layer (123) is disposed on first dielectric focusing layer (122). The dielectric constant of second dielectric focusing layer (123) is less than the dielectric constant of first dielectric focusing layer (122). During the operation of field emission device (110, 210, 310), electron emitter (124) emits an electron beam (134), which is focused as it travels through first aperture (127) and then through second aperture (133).

27 Claims, 4 Drawing Sheets

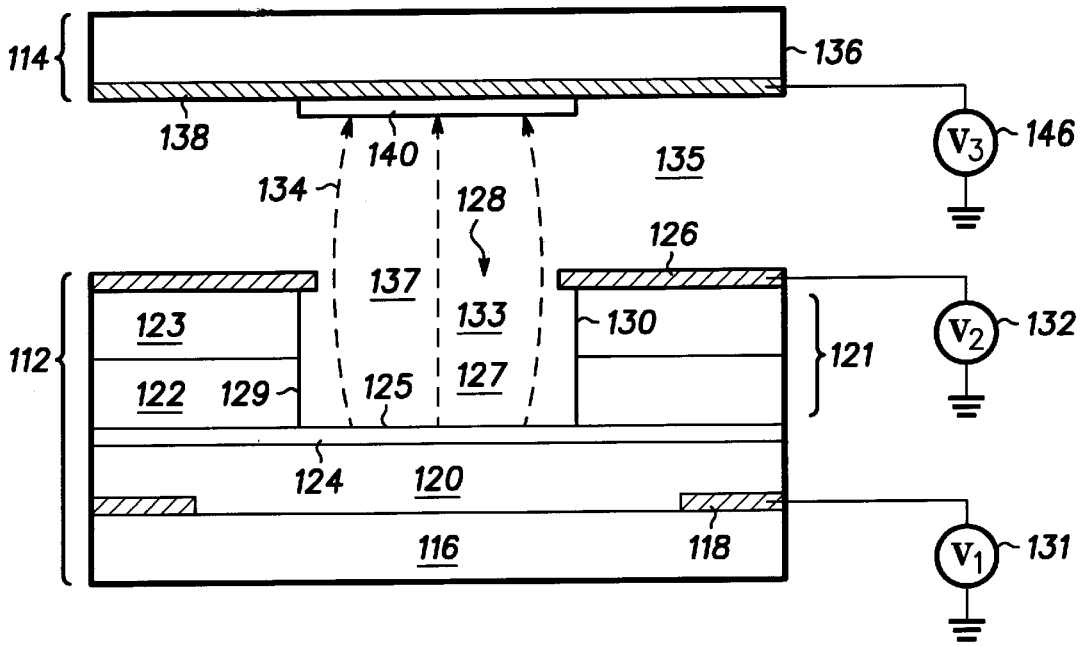
110 FIG. 1
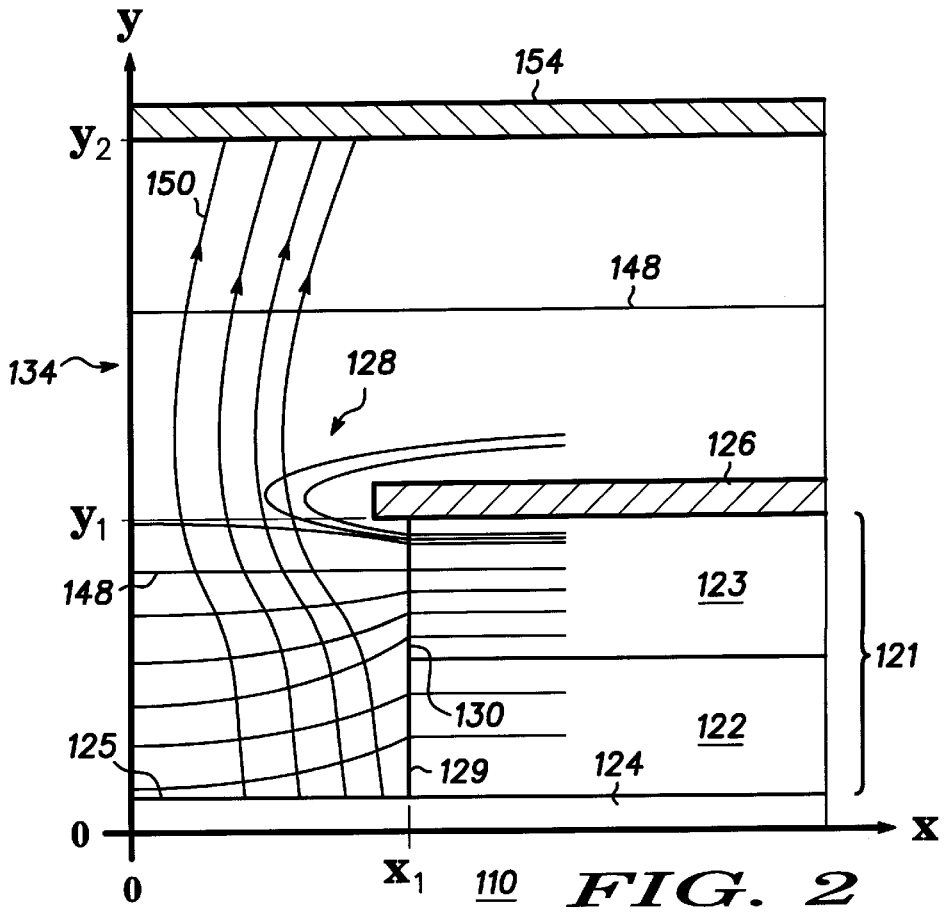
110 FIG. 2

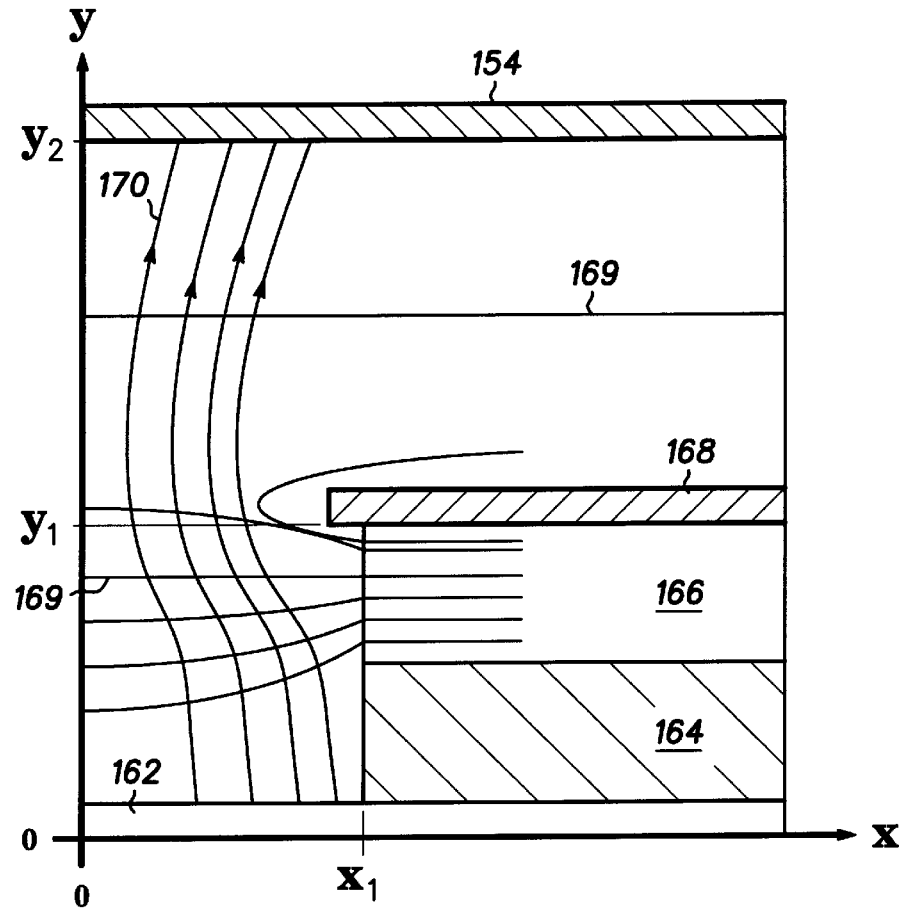
FIG. 3 - PRIOR ART -
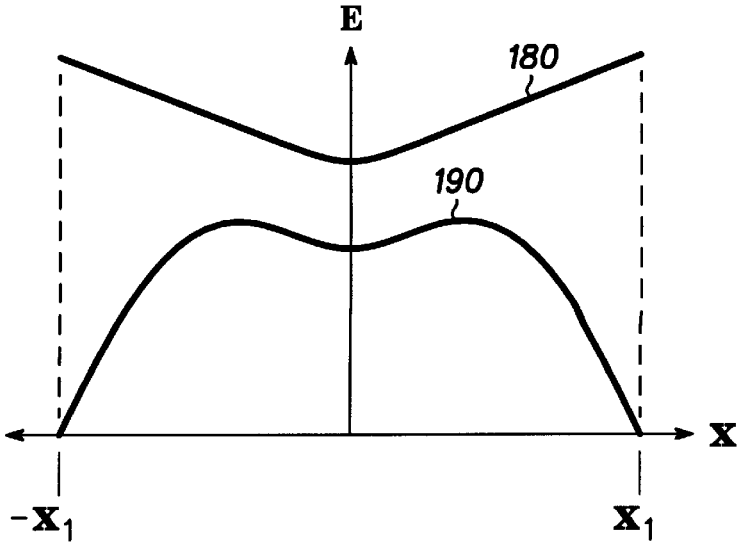
FIG. 4

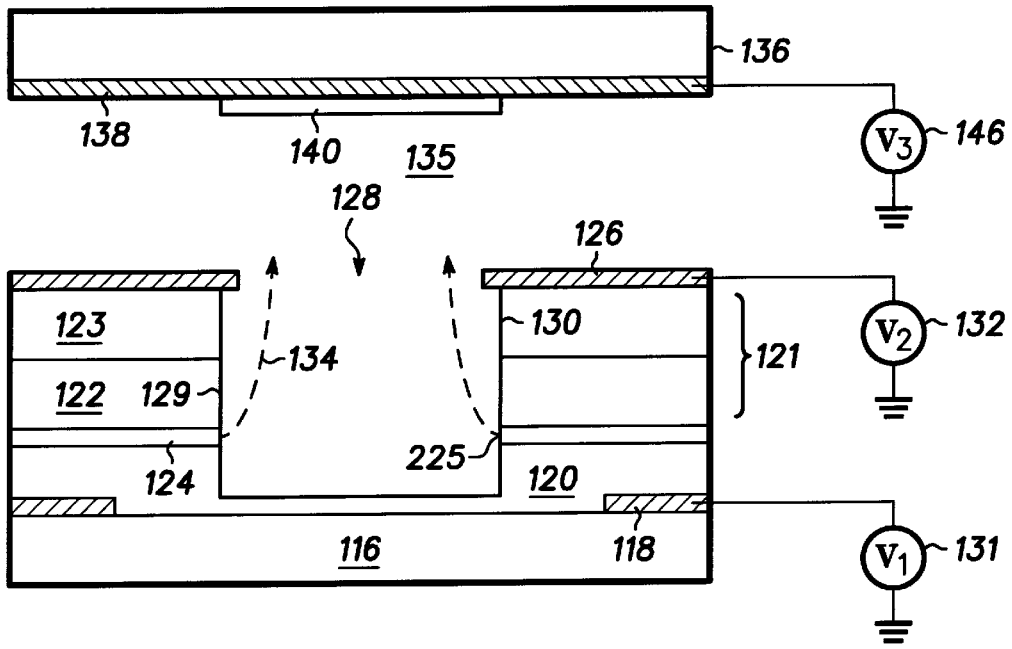
210 FIG. 5
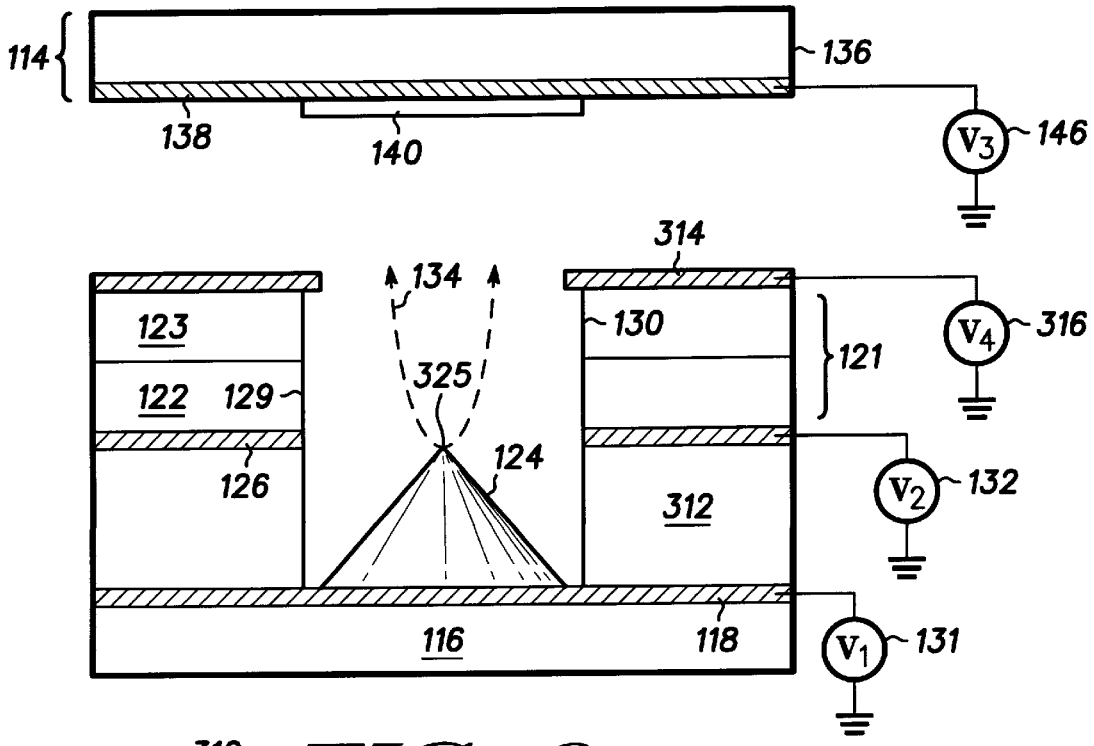
310 FIG. 6

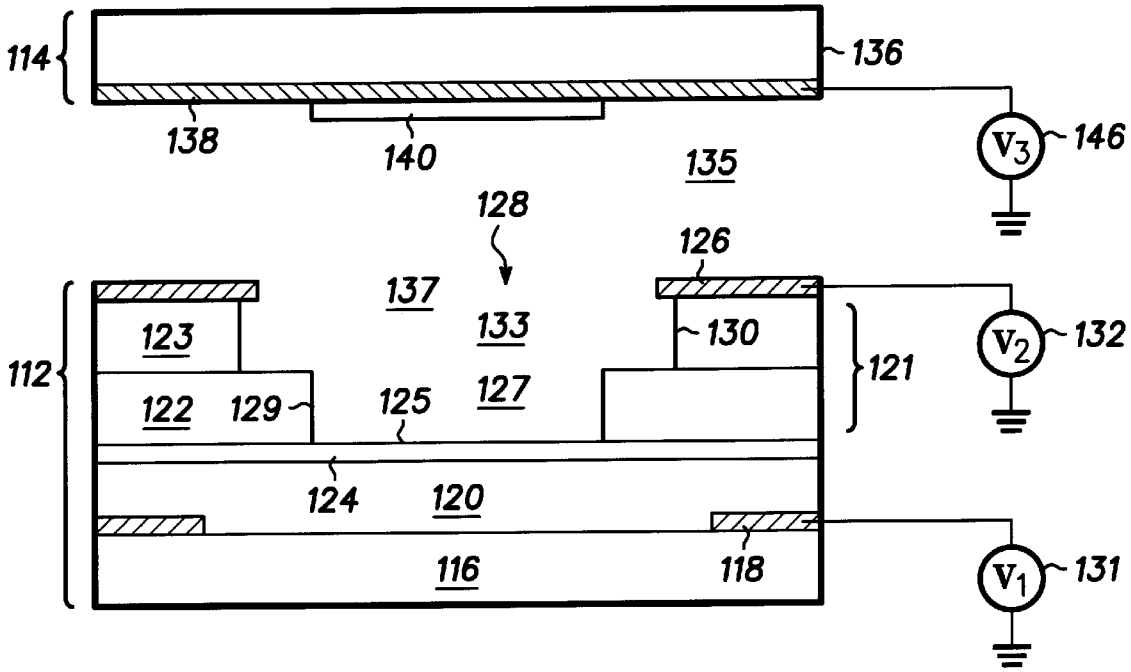
410 FIG. 7

FIELD EMISSION DEVICE HAVING DIELECTRIC FOCUSING LAYERS

FIELD OF THE INVENTION

The present invention relates, in general, to field emission devices having focusing structures for focusing electron beams.

BACKGROUND OF THE INVENTION

Field emission displays are well known in the art. A field emission display includes an anode plate and a cathode plate that define a thin envelope. The anode plate and cathode plate can be separated by dielectric spacer structures. The cathode plate includes column electrodes and gate extraction electrodes, which are used to cause selective electron emission from electron emitters, such as Spindt tips or emissive surfaces.

The separation distance between the anode plate and the cathode plate has a lower limit. The minimum distance is determined by the break down voltage of the dielectric spacer structures and by the need to avoid arcing between the anode plate and the cathode plate. Especially at high anode voltages, the minimum separation distance can result in electron beams that have unacceptably large cross-sections at the anode plate. It is known in the art to use additional electrically conductive layers or electrically resistive layers for the purpose of focusing the electron beams to achieve a desired cross-section at the anode plate. Benefits, such as improved resolution of a display image, can be realized by the focusing.

It is also known in the art to use an electrically conductive or electrically resistive layer, which circumscribes an emissive surface, for reducing leakage currents at the gate extraction electrode.

However, the use of these additional layers can result in problems, such as suppression of the electric field at the electron emitter as well as unacceptable, spurious electron emission from the additional material.

Accordingly, there exists a need for a field emission display having an improved focusing structure, which overcomes at least some of these shortcomings.

BRIEF DESCRIPTION OF THE DRAWINGS

Referring to the drawings:

FIG. 1 is a cross-sectional view of a field emission device, in accordance with a preferred embodiment of the invention;

FIG. 2 is a computer model representation of one half of the cross-sectional view of the field emission device of FIG. 1;

FIG. 3 is a computer model representation of one half of a cross-sectional view of a prior art field emission device;

FIG. 4 is a graphical representation of electric field strength versus position along the x-axis for the structures of FIGS. 2 and 3;

FIG. 5 is a cross-sectional view of a field emission device having an edge emitter, in accordance with another embodiment of the invention;

FIG. 6 is a cross-sectional view of a field emission device having a dielectric focusing structure disposed above a gate extraction electrode, in accordance with yet another embodiment of the invention; and FIG. 7 is a cross-sectional view of a field emission device having a dielectric focusing structure that defines apertures of dissimilar sizes, in accordance with a further embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

Herein, the term "dielectric" is used to describe materials having a resistivity greater than or equal to $10^{10}$ ohm-cm, and the term "non-dielectric" is used to describe materials having a resistivity less than $10^{10}$ ohm-cm. Non-dielectric materials are divided into electrically conductive materials, for which the resistivity is less than 1 ohm-cm, and electrically resistive materials, for which the resistivity is within a range of 1 ohm-cm to $10^{10}$ ohm-cm. These categories are determined at an electric field of no more than 1 volt/pm.

The invention is for a field emission device having a dielectric focusing structure. The dielectric focusing structure of the invention is a multi-layer structure. Each of the layers of the multi-layer structure is made from a dielectric material. The dielectric constants of the layers decrease in the direction of electron flow. The dielectric focusing structure of the invention provides improved electric field strength at the electron emitter or, equivalently, lower operating gate voltage, when contrasted with the focusing structures of the prior art. The dielectric focusing structure of the invention is also useful for focusing the electron beams to provide low leakage current at the gate extraction electrode. In the application of a field emission display, improved display image resolution can be achieved.

FIG. 1 is a cross-sectional view of a field emission device (FED) 110, in accordance with a preferred embodiment of the invention. Although the embodiment of FIG. 1 is a display device, the scope of the invention is not limited to display devices. Rather, the invention can be embodied by other types of electronic devices, such as field effect transistors. FED 110 includes a cathode plate 112 and an anode plate 114, which define an interspace region 135 therebetween.

Cathode plate 112 includes a substrate 116, which can be made from glass, silicon, and the like. A column electrode 118 is disposed upon substrate 116. Column electrode 118 is made from an electrically conductive material, such as aluminum, molybdenum, and the like. Column electrode 118 is connected to a first voltage source 131, $V_1$.

A ballast resistor layer 120 is disposed on column electrode 118. Ballast resistor layer 120 is made from an electrically resistive material, such as a phosphorus-doped, amorphous silicon. The resistivity of ballast resistor layer 120 is about $10^7$ ohm-cm.

An electron emitter 124 is formed on ballast resistor layer 120. In the embodiment of FIG. 1, electron emitter 124 defines an emissive surface 125.

The resistivity of ballast resistor layer 120 is greater than that of column electrode 118 and is selected to cause uniform electron emission over emissive surface 125.

In FED 110, electron emitter 124 is a layer of an electron-emissive material. Preferably, the electron-emissive material is characterized by a turn-on field of less than 100 volts/pm. In general, the turn-on field is the electric field at the emissive surface, which causes the material to emit at a current density of $10^{-4}$ amps/cm$^2$. The electron-emissive material can be selected from materials having low work functions, such as diamond-like carbon, diamond, partially graphitized nanocrystalline carbon, and the like.

In accordance with the invention, cathode plate 112 further includes a dielectric focusing structure 121. In the embodiment of FIG. 1, dielectric focusing structure 121 is disposed on electron emitter 124. Dielectric focusing structure 121 includes a first dielectric focusing layer 122 and a second dielectric focusing layer 123.

First dielectric focusing layer 122 is disposed on electron emitter 124 and has a surface 129, which defines a first aperture 127. Second dielectric focusing layer 123 is disposed on first dielectric focusing layer 122 and has a surface 130, which defines a second aperture 133. First aperture 127 and second aperture 133 partially define an emitter well 128. In accordance with the invention, the dielectric constant of first dielectric focusing layer 122 is greater than the dielectric constant of second dielectric focusing layer 123.

The scope of the invention is not limited to a dielectric focusing structure having only two dielectric focusing layers. More than two dielectric focusing layers can be employed. In accordance with the invention, the dielectric constants of the layers decrease with distance from the electron emitter.

Preferably, first dielectric focusing layer 122 is made silicon nitride, which has a dielectric constant of 7.9, and second dielectric focusing layer 123 is made from silicon dioxide, which has a dielectric constant of 3.9. However, the scope of the invention is not limited to these dielectric materials.

Cathode plate 112 further includes a gate extraction electrode 126, which is disposed on second dielectric focusing layer 123. Gate extraction electrode 126 defines a third aperture 137, which further defines emitter well 128. A second voltage source 132, $V_2$, is connected to gate extraction electrode 126. First, second, and third apertures 127, 133, and 137 are disposed to allow passage therethrough of an electron beam 134.

In accordance with the invention, the thickness and the dielectric constant of each of first and second dielectric focusing layers 122 and 123 are selected to cause the focusing of electron beam 134. Electron beam 134 is focused at least to an extent sufficient to avoid receipt of electron beam 134 by gate extraction electrode 126.

Anode plate 114 is disposed to receive electron beam 134. Anode plate 114 includes a transparent substrate 136 made from, for example, glass. An anode 138 is disposed on transparent substrate 136. Anode 138 is preferably made from a transparent, electrically conductive material, such as indium tin oxide. A third voltage source 146, $V_3$, is connected to anode 138.

A phosphor 140 is disposed upon anode 138. Phosphor 140 is cathodoluminescent. Thus, phosphor 140 emits light upon activation by electron beam 134. Methods for fabricating anode plates for matrix-addressable field emission displays are known to one of ordinary skill in the art.

Cathode plate 112 is fabricated using convenient deposition and patterning methods known to one skilled in the art. In the embodiment of FIG. 1, electron emitter 124 can be formed by a deposition technique, such as vacuum arc deposition, plasma enhanced chemical vapor deposition, other forms of chemical vapor deposition, spin-on techniques, various growth techniques, and the like.

The operation of FED 110 includes the step of applying potentials at column electrode 118 and gate extraction electrode 126, which are useful for causing electron emission from emissive surface 125. A potential is applied to anode 138 for attracting the electrons to anode 138.

FIG. 2 is a computer model representation of one half of the crosssectional view of FED 110 of FIG. 1. FIG. 2 does not include anode plate 114. Rather, a simulation boundary 154 is utilized in the computer model. Simulation boundary 154 represents a voltage of 150 volts. The abscissa represents a position, x, along electron emitter 124. The ordinate represents the axis of symmetry of the structure. A first distance, $x_1$, on the abscissa is equal to about 2 micrometers, and a first distance, $y_1$, on the ordinate is equal to about 1.0 micrometer. Simulation boundary 154 is positioned at a second distance, $y_2$, which is equal to approximately 10 micrometers, on the ordinate.

Further illustrated in FIG. 2 are a plurality of equipotential lines 148 and a plurality of electron trajectories 150 generated by the computer model, for the following conditions: a gate voltage at gate extraction electrode 126 of about 100 volts, electron emitter 124 at ground potential, and a potential at simulation boundary 154 of about 150 volts.

Illustrated in FIG. 2 is the warping or shaping of the of the electric field within emitter well 128 due to the dissimilar dielectric properties of first and second dielectric focusing layers 122 and 123. The shaping of the field is sufficient to direct electron beam 134 in a direction toward the axis of symmetry of emitter well 128. This focusing ameliorates the impingement of electrons upon gate extraction electrode 126 and upon surfaces 129 and 130 of first and second dielectric focusing layers 122 and 123, respectively.

FIG. 3 is a computer model representation of one half of a cross-sectional view of a prior art field emission device (FED) 160. Prior art FED 160 includes an electron emitter 162, a non-dielectric layer 164 disposed on electron emitter 162, a dielectric layer 166 of silicon dioxide disposed on non-dielectric layer 164, and a gate extraction electrode 168 formed on dielectric layer 166.

FIG. 3 illustrates a plurality of equipotential lines 169 and a plurality of electron trajectories 170 generated by the computer model, using the distances ($x_1$, $y_1$, $y_2$), simulation boundary 154, and operating voltages described with reference to FIG. 2. Also, non-dielectric layer 164 is at ground potential. Contrasting equipotential lines 169 of FIG. 3 with equipotential lines 148 of FIG. 2, it is evident that prior art non-dielectric layer 164 (FIG. 3) suppresses the electric field at the emissive surface to a greater extent than does dielectric focusing structure 121 (FIG. 2) of the invention.

FIG. 4 is a graphical representation of electric field strength, E, versus position, x, along the electron emitter for the structures of FIGS. 2 and 3. A graph 190 is a general representation of electric field strength at the emissive surface of prior art FED 160. Although prior art FED 160 focuses the electron beam, the focusing effect is due to warping of the field lines caused by field retardation because the normal field at the edge of non-dielectric layer 164 is forced to zero by non-dielectric layer 164.

In contrast, the normal field at the edge of first dielectric focusing layer 122 is not forced to zero, as illustrated by a graph 180 of electric field strength, E, versus position, x, for FED 110. Consequently, the electric field strength is greater for FED 110 than prior art FED 160 for all positions along the emissive surface. In accordance with the invention, reduced field suppression at emissive surface 125 allows the use of a reduced operating voltage at gate extraction electrode 126.

FIG. 5 is a cross-sectional view of a field emission device (FED) 210, in accordance with another embodiment of the invention. In the embodiment of FIG. 5, electron emitter 124 defines an emissive edge 225, rather than an emissive surface. Emissive edge 225 is located at a distance above the bottom surface of emitter well 128. This configuration provides improved electric field properties at emissive edge 225.

The fabrication of FED 210 includes the fabrication steps described with reference to FIG. 1 and further includes the step of removing electron-emissive material from the bottom of emitter well 128. The fabrication of FED 210 also includes the step of selectively and partially etching ballast resistor layer 120, so that the bottom surface of emitter well 128 lies below a plane defined by electron emitter 124.

One of the advantages of the configuration of FED 210 is that fewer contaminant ions per unit area impinge upon the generally vertical walls of emitter well 128, than upon the bottom surface of emitter well 128. By reducing ionic bombardment at emissive edge 225, the lifetime of the device can be increased.

FIG. 6 is a cross-sectional view of a field emission device (FED) 310, in accordance with yet another embodiment of the invention. In the embodiment of FIG. 6, dielectric focusing structure 121 is disposed above gate extraction electrode 126, rather than below. Also, in the embodiment of FIG. 6, electron emitter 124 defines an emissive tip 325. In FED 310, electron emitter 124 can be a Spindt tip electron emitter.

In the embodiment of FIG. 6, gate extraction electrode 126 is separated from column electrode 118 by a third dielectric layer 312, which is preferably made from silicon dioxide. FED 310 further includes an electrode 314 disposed on dielectric focusing structure 121. A fourth voltage source 316, $V_4$, is connected to electrode 314. In the operation of FED 310, the potential applied to electrode 314 is greater than the potential applied to gate extraction electrode 126.

Methods for fabricating Spindt tip electron emitters are known to one skilled in the art. In the fabrication of FED 310, dielectric focusing structure 121 and electrode 314 are fabricated subsequent to the formation of the Spindt tip electron emitters, by using convenient deposition and etch techniques.

FIG. 7 is a cross-sectional view of a field emission device (FED) 410, in accordance with a further embodiment of the invention. In the embodiment of FIG. 7, dielectric focusing structure 121 defines apertures of dissimilar sizes. Preferably, the size of first aperture 127 is less than the size of second aperture 133. Most preferably, each of first aperture 127 and second aperture 133 has a circular cross-section, and the diameter of first aperture 127 is less than the diameter of second aperture 133.

The fabrication of FED 410 includes the fabrication steps described with reference to FIG. 1 and further includes, subsequent to the step of forming second aperture 133 in second dielectric focusing layer 123, the step of forming a sidewall on surface 130. The sidewall is formed prior to the step of forming first aperture 127 in first dielectric focusing layer 122. The thickness of the sidewall at the upper surface of first dielectric focusing layer 122 defines half of the difference between the diameters of first aperture 127 and second aperture 133. After the step of forming first aperture 127, the sidewall is removed.

In summary, the invention is for a field emission device having a dielectric focusing structure. The device of the invention provides at least the benefit of lower operating gate voltage over that of the prior art.

While we have shown and described specific embodiments of the present invention, further modifications and improvements will occur to those skilled in the art. For example, the ballast resistor layer can be omitted. As a further example, one of the dielectric focusing layers can be made from barium titanate.

We desire it to be understood, therefore, that this invention is not limited to the particular forms shown and we intend in the appended claims to cover all modifications that do not depart from the spirit and scope of this invention.

What is claimed is:

1. A field emission device comprising:

an electron emitter designed to emit an electron beam;

a first dielectric focusing layer defining a first aperture and characterized by a first dielectric constant, wherein the first aperture is disposed to allow passage therethrough of the electron beam; and a second dielectric focusing layer defining a second aperture and characterized by a second dielectric constant, wherein the second dielectric focusing layer is disposed over the first dielectric focusing layer, wherein the second aperture is disposed to allow passage therethrough of the electron beam, and wherein the second dielectric constant is less than the first dielectric constant.

2. The field emission device as claimed in claim 1, wherein the first dielectric focusing layer comprises silicon nitride, and wherein the second dielectric focusing layer comprises silicon dioxide.

3. The field emission device as claimed in claim 1, wherein the electron emitter defines an emissive surface.

4. The field emission device as claimed in claim 3, wherein the electron emitter comprises an electron-emissive material characterized by a turn-on field of less than 100 volts/$\mu$m.

5. The field emission device as claimed in claim 1, further comprising a gate extraction electrode disposed on the second dielectric focusing layer, wherein the gate extraction electrode defines a third aperture disposed to allow passage therethrough of the electron beam.

6. The field emission device as claimed in claim 5, wherein the first dielectric focusing layer has a first thickness; wherein the second dielectric focusing layer has a second thickness; and wherein the first dielectric constant, the second dielectric constant, the first thickness, and the second thickness are selected to cause the electron beam to be focused to an extent sufficient to avoid receipt of the electron beam by the gate extraction electrode.

7. The field emission device as claimed in claim 1, further comprising a gate extraction electrode, wherein the gate extraction electrode defines a third aperture disposed to allow passage therethrough of the electron beam, and wherein the first dielectric focusing layer is disposed on the gate extraction electrode.

8. The field emission device as claimed in claim 1, wherein the first dielectric focusing layer is characterized by a resistivity of not less than $10^{10}$ ohm-cm.

9. The field emission device as claimed in claim 1, wherein the first aperture of the first dielectric focusing layer has a size, wherein the second aperture of the second dielectric focusing layer has a size, and wherein the size of the first aperture is less than the size of the second aperture.

10. A field emission device comprising:

an electron emitter designed to emit an electron beam;

a first dielectric focusing layer defining a first aperture and characterized by a first dielectric constant; and a second dielectric focusing layer defining a second aperture and characterized by a second dielectric constant, wherein the first aperture and the second aperture are disposed to allow passage therethrough of the electron beam in a direction from the first aperture to the second aperture, and wherein the second dielectric constant is less than the first dielectric constant.

11. The field emission device as claimed in claim 10, wherein the first dielectric focusing layer comprises silicon nitride, and wherein the second dielectric focusing layer comprises silicon dioxide.

12. The field emission device as claimed in claim 10, wherein the electron emitter defines an emissive surface.

13. The field emission device as claimed in claim 10, wherein the electron emitter comprises an electron-emissive material characterized by a turn-on field of less than 100 volts/pm.

14. The field emission device as claimed in claim 10, further comprising a gate extraction electrode disposed on the second dielectric focusing layer, wherein the gate extraction electrode defines a third aperture disposed to allow passage therethrough of the electron beam.

15. The field emission device as claimed in claim 14, wherein the first dielectric focusing layer has a first thickness; wherein the second dielectric focusing layer has a second thickness; and wherein the first dielectric constant, the second dielectric constant, the first thickness, and the second thickness are selected to cause the electron beam to be focused to an extent sufficient to avoid receipt of the electron beam by the gate extraction electrode.

16. The field emission device as claimed in claim 10, further comprising a gate extraction electrode, wherein the gate extraction electrode defines a third aperture disposed to allow passage therethrough of the electron beam, and wherein the first dielectric focusing layer is disposed on the gate extraction electrode.

17. The field emission device as claimed in claim 10, wherein the first dielectric focusing layer is characterized by a resistivity of not less than $10^{10}$ ohm-cm.

18. The field emission device as claimed in claim 10, wherein the first aperture of the first dielectric focusing layer has a size, wherein the second aperture of the second dielectric focusing layer has a size, and wherein the size of the first aperture is less than the size of the second aperture.

19. A field emission device comprising:

an electron emitter designed to emit an electron beam;

a first dielectric focusing layer defining a first aperture and characterized by a first dielectric constant; and a second dielectric focusing layer defining a second aperture and characterized by a second dielectric constant, wherein the second dielectric focusing layer is disposed on the first dielectric focusing layer, wherein the first aperture and the second aperture are disposed to allow passage therethrough of the electron beam in a direction from the first aperture to the second aperture, and wherein the second dielectric constant is less than the first dielectric constant.

20. The field emission device as claimed in claim 19, wherein the first dielectric focusing layer comprises silicon nitride, and wherein the second dielectric focusing layer comprises silicon dioxide.

21. The field emission device as claimed in claim 19, wherein the electron emitter defines an emissive surface.

22. The field emission device as claimed in claim 19, wherein the electron emitter comprises an electron-emissive material characterized by a turn-on field of less than 100 volts/pm.

23. The field emission device as claimed in claim 19, further comprising a gate extraction electrode disposed on the second dielectric focusing layer, wherein the gate extraction electrode defines a third aperture disposed to allow passage therethrough of the electron beam.

24. The field emission device as claimed in claim 23, wherein the first dielectric focusing layer has a first thickness; wherein the second dielectric focusing layer has a second thickness; and wherein the first dielectric constant, the second dielectric constant, the first thickness, and the second thickness are selected to cause the electron beam to be focused to an extent sufficient to avoid receipt of the electron beam by the gate extraction electrode.

25. The field emission device as claimed in claim 19, further comprising a gate extraction electrode, wherein the gate extraction electrode defines a third aperture disposed to allow passage therethrough of the electron beam, and wherein the first dielectric focusing layer is disposed on the gate extraction electrode.

26. The field emission device as claimed in claim 19, wherein the first dielectric focusing layer is characterized by a resistivity of not less than $10^{10}$ ohm-cm.

27. The field emission device as claimed in claim 19, wherein the first aperture of the first dielectric focusing layer has a size, wherein the second aperture of the second dielectric focusing layer has a size, and wherein the size of the first aperture is less than the size of the second aperture.

* * * * *